US005577471A

United States Patent [19]

Ward

[11] Patent Number: 5,577,471

[45] Date of Patent: Nov. 26, 1996

[54] LONG-LIFE, ANTI-FOULING, HIGH CURRENT, EXTENDED GAP, LOW HEAT CAPACITY HALO-DISC SPARK PLUG FIRING END

[76] Inventor: Michael A. V. Ward, 32 Prentiss Rd., Lexington, Mass. 02174

[21] Appl. No.: 492,975

[22] Filed: Jun. 21, 1995

[51] Int. Cl.[6] ..... F02P 5/00

[52] U.S. Cl. ..... 123/169 EL

[58] Field of Search ..... 123/169 EL, 169 MG, 123/169 R; 313/141, 142

[56] References Cited

U.S. PATENT DOCUMENTS

| | | | |
|---|---|---|---|
| 968,687 | 8/1910 | Provandie | 123/169 EL |
| 2,071,450 | 2/1937 | Anderson | 123/169 EL |
| 2,292,216 | 8/1942 | Doran | 123/169 EL |
| 2,301,686 | 11/1942 | Doran | 123/169 EL |
| 4,730,582 | 3/1988 | Lindsay | 123/169 MG |
| 5,373,214 | 12/1994 | McCready | 313/142 |
| 5,408,961 | 4/1995 | Smith | 123/169 R |
| 5,461,275 | 10/1995 | Oshima | 313/141 |
| 5,493,171 | 2/1996 | Wood, III et al. | 313/141 |

*Primary Examiner*—Raymond A. Nelli
*Attorney, Agent, or Firm*—Jerry Cohen

[57] ABSTRACT

An improved anti-fouling controlled erosion long life spark plug (36) for high current arc type spark discharges with low heat absorbing large circular gap (31) electrode structure comprised of a conical section center electrode (26) and low mass ring ground electrode (21) supported by three legs (24) defining flow-through slots (25) behind the ring which extends into the combustion chamber and an insulator end (13*a*) recessed with respect to the flow-through slots to prevent its fouling, the plug end electrode structure minimizing flow obstruction, flame quenching, and heat absorption from the combusting air-fuel mixture.

28 Claims, 2 Drawing Sheets

FIG.1a PRIOR ART
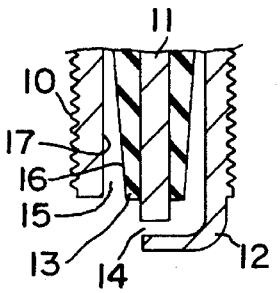
FIG.1b PRIOR ART
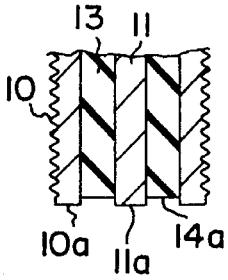
FIG.1c PRIOR ART
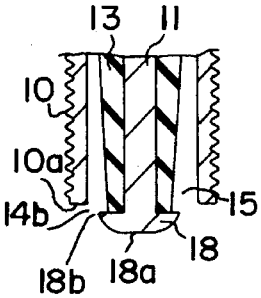
FIG.1d PRIOR ART
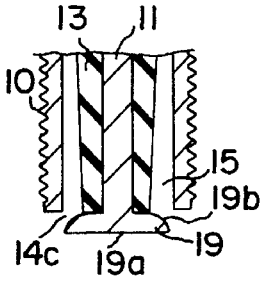
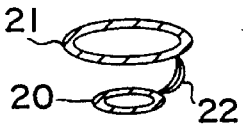
FIG.2a
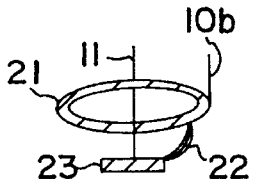
FIG.2b
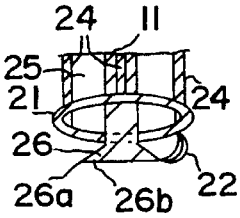
FIG.2c
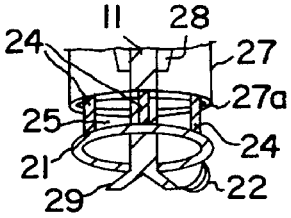
FIG.2d
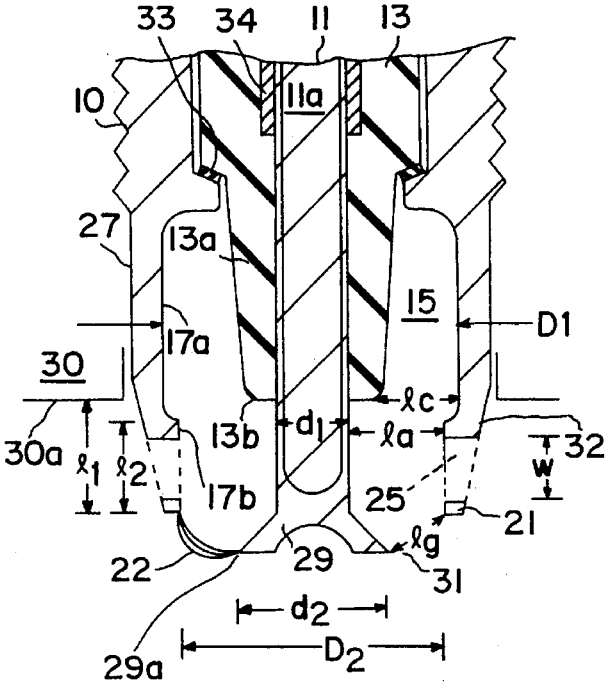
FIG.3
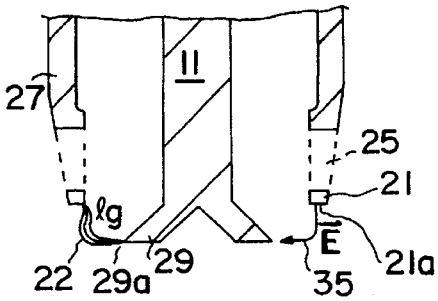
FIG.3a
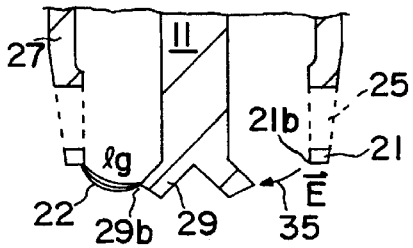
FIG.3b

LONG-LIFE, ANTI-FOULING, HIGH CURRENT, EXTENDED GAP, LOW HEAT CAPACITY HALO-DISC SPARK PLUG FIRING END

BACKGROUND OF THE INVENTION AND PRIOR ART

The present invention relates to spark plugs for high power high energy ignition systems for use in internal combustion engines with difficult-to-ignite dilute mixtures, such as lean mixtures and high exhaust residual or high EGR mixtures. High power ignition systems delivering 100's of watts of power for a time duration of 0.2 to 2 millisecond (msec) increase the engine's tolerance for dilute operation for more efficient and cleaner combustion.

To produce the high spark power of typically 50 to 500 watts high current arc type spark discharges are required. Arc discharges are also required to avoid spark break-up or spark segmentation at high air-flows which are favored as they increase the engine's tolerance for dilution and increase the bum rate. More specifically, an arc discharge in the 1 to 10 amps range maintained across a wide spark gap of 1.5 to 3 millimeters or greater provides the 50 to 500 watts of required power and the tolerance to high bulk flows of 20 meters/second (m/sec) at the spark plug site without spark segmentation. A hybrid single or dual discharge type ignition, disclosed in PCT patent application Ser. No. 94/12866 (including U.S. designation), provides such an arc discharge with the required spark power of 50 to 500 watts and the required spark duration of 0.2 to 2 milliseconds without spark segmentation or break-up under high flow conditions.

Such an arc discharge places high stress on the spark plug in terms of erosion, fouling, and over heating of the spark plug firing end. Conventional spark plugs with standard material "J" ground electrodes, or even multiple ground electrodes, erode far too quickly under arc discharge operation to be useful, and surface gap plugs short out too quickly. More advanced circular gap spark plugs can last longer but cannot meet the new goals of even longer spark plug life without compromising other important ignition characteristics.

Conventional glow discharge ignitions, which produce relatively little erosion at the spark plug (versus the arc discharge), provide only 5 to 25 watts to the mixture, and high energy ignition, HEI, supplies only twice that amount, less than the required 100's of watts of power. Moreover, under conditions of moderately high flow as found in some modern engines, the spark discharge of even the HEI system is broken-up, or segmented, to compromise igniting ability. Variants of HEI systems which use alternating current (AC) sparks and provide low plug erosion, perform even worse under conditions of bulk flow since they already provide, by definition, an undesirable segmented spark.

It is therefore desirable to employ an ignition system that can supply the required 100's of watts of ignition power in the form of a single polarity arc type spark discharge resistant to spark segmentation under high bulk flow conditions of 5 m/sec and greater, and to employ a spark plug that can withstand the higher required spark currents as well as the higher flow conditions with acceptable electrode erosion, without spark plug fouling, without electrode interference or quenching of the initial flame front, and without absorbing excessive combustion heat from the high temperatures that exist at the spark plug site.

Circular or toroidal gap spark plugs are best suited for this application. Early versions are disclosed as part of higher power ignition systems in U.S. Pat. Nos. 4,677,960, 4,774,914, 4,841,925, 5,207,208, 5,131,376, 5,211,147, and 5,315,982 which are of common assignment with this patent application with Dr. M. A. V. Ward as a sole or joint inventor (and are incorporated herein by reference as though set out at length herein). However, these and other circular gap spark plugs, disclosed in other patents, have large high heat capacity flame quenching electrodes, are subject to spark plug fouling by electrode material being deposited on the spark plug insulator nose, have a relatively recessed spark, or require firing to the piston at some or all of their operating conditions to improve their operation.

SUMMARY OF THE INVENTION

On the other hand, the present invention discloses a spark plug which has a large spark gap and circularly and axially extended thin low-mass spark firing electrodes for long electrode life, for good combustion chamber penetration, and for minimum heat absorption and flame quenching. The electrodes are in the form of a thin central disk high voltage electrode and a circular ring ground electrode resembling a halo, hence the name "halo-disc", to define the preferred low, or controlled, erosion circular gap (made of erosion resistant material) comprising two thin circular firing edges which are far removed from a recessed plug insulating nose to minimize plug fouling, and which present minimum interference or quenching of the initial flame and minimum absorption of combustion heat energy due to the low heat capacity of the "halo-disc" electrode structure. Such halo-disc firing end electrodes are of sufficient size and composition to handle the high spark currents but otherwise devoid of mass to minimize flame quenching and combustion heat absorption, which is aggravated due to the high combustion temperatures found at the spark plug site, i.e. the first part of the mixture to bum becomes the hottest.

While the halo-disc plug employs features common to the prior designs of a circular gap with firing electrodes of erosion resistant material such as tungsten-nickel-iron, it differs in several important respects from prior designs in that: 1) the ground electrode is in the form of a small, low heat capacity ring, of ring inside diameter (ID) about 10 mm and of cross-sectional metal ring diameter of about 1 mm, instead of the typical heavy wall tubular cylindrical end deformed by the ground end of the spark plug shell; 2) the center disk electrode and ground ting electrode extend into the combustion chamber by about 3 mm by having the ground. ring be supported by three or more legs of, for example, about 1 mm by about 2 mm cross-sectional dimension and about 3 mm length, which can be fabricated by milling three or more slots of about 3 mm slot width in an extending portion of a properly shaped spark plug shell end; 3) the end of the spark plug center insulator is recessed with respect to the slots to minimize the local electric field strength and to prevent the insulator end from being fouled by electrode material deposits from spark firing, the anti-fouling feature being further enhanced by the flow-through slots defined by the ring support legs which allow the region between the halo ring ground electrode and insulator end to be scavenged and cleared; 4) the insulator end is fabricated to have a diameter of 4 mm to 5 mm so as to have a clearance to the inside wall of the spark plug shell which is the maximum allowed (of about 10 mm for a 14 mm spark plug) of approximately equal to or greater than the spark gap, and to form its minimum gap with a smooth inside shell surface away frown the edge of the flow-through slots; 5) the high voltage center conductor and insulator end are well heat sunk to prevent over heating; and 6) the plug is provided with other features and dimensions to allow for optimal operation of the spark plug firing end under the severe sparking conditions of the high current arc discharge.

For ease of discussion, and for the purpose of reference, a list of criteria and desired features for the spark plug firing end is introduced and termed the "Arc Discharge Plug Effectiveness" criteria, or ADPE criteria. They include and are not limited to: 1) minimal or controlled erosion of the electrodes to give acceptable spark plug life; 2) anti-fouling features of the insulator and plug end; 3) low heat capacity of the spark plug end to minimize flame quenching and heat absorption; 4) electrode positioning and orientation to produce a large spark gap with outwardly moving spark kernel and good spark penetration into the combustion chamber with good coupling of the arc discharge to the mixture flow; 5) minimal electrode interference with the initial flame and the bulk flows; 6) acceptable breakdown voltage for the spark gap, even as the spark gap increases as a result of the controlled erosion; 7) good heat sinking of the electrodes and other factors disclosed herein.

The term "circular" or "toroidal" gap means a gap region within which a partially radial, partially axial, i.e. quasi-radial-axial, spark gap is defined between two adjacent points on two concentric circular surfaces generally not in the same plane.

The term "about" as used herein means within a factor of one half and two of the quantity it references, and the term "approximately" means within plus or minus 25% of the quantity it references.

Given the discussion and disclosure of the ADPE criteria, it is a principal object of the present invention to provide a spark plug firing end which has extensive, combustion chamber penetrating, circular, thin, low mass electrodes made of erosion resistant material to give long spark plug life under severe spark firing conditions, to provide minimum flame quenching and heat absorption, to give maximum combustion chamber penetration of a large spark kernel, and to provide a recessed insulator of small end dimension (for a conventional 14 mm spark plug) to prevent fouling of the spark plug end and internal firing.

It is a further object to dimension the spark gap to provide the largest practical gap for each spark plug type and engine application and to position and dimension the insulator end so that even if its end surface becomes conducting due to fouling it will not fire because of the large gap to the inside shell of the spark plug because the electric field strength at the potential firing surfaces will be much less than the field at the firing edge of the central disk electrode.

Another object is to shape the firing edge of the central spark firing disk electrode, and to locate it relative to the ring electrode so that its largest diameter edge, which represents the firing edge, represents the extremity of the plug tip and the region of highest electric field, so that under spark firing conditions it produces a spark that is positioned outward and away from the central spark plug wire, and it further produces a more favorable (higher) electric field with the ground ring as it erodes and the spark gap increases.

Another object is to have a moderate length insulator nose and copper core center conductor to prevent their overheating and to heat sink them well to the spark plug shell so as to keep the spark plug end at a suitable temperature.

Another object, where practical, is to increase the spark plug shell to accommodate a larger shell with, for example, 15 mm, 16 mm, or ⅝" thread with, say, 11/16" hex, versus the conventional 14 mm thread with ⅝" hex, so as to accommodate a larger plug shell inside diameter (ID) at the insulator end region of approximately 1 cm without undue thinning and weakening of the shell wall and be able to prevent internal firing and provide for a large spark gap of approximately 2 mm to 3 mm.

Another object is to support the Found ring electrode with "legs" that both define a suitable penetration of the spark gap into the combustion chamber of, for example, about 3 mm for a conventional internal combustion (IC) engine, and which define a flow-through region between the ground ring and the beginning of the solid cylindrical surface of the spark plug shell.

Another object is to design the electrode structure to produce a large spark, e.g. of 2 mm to 4 mm length, in a direction that couples efficiently with the engine mixture flow (at the spark plug site at the time of spark ignition). Such coupling (and clearing of the spark gap to minimize fouling) is improved by having the gap length define a spark length direction more perpendicular than parallel to the local mixture flow direction at the time of ignition.

Another object is to provide a very long life spark plug of 50,000 vehicle miles or more as is currently being demanded for future vehicles to minimize servicing and/or replacement of the plugs.

Other features and objects of the invention will be apparent from the following detailed description of preferred embodiments taken in conjunction with the accompanying drawings, in which:

BRIEF DESCRIPTION OF THE DRAWINGS

FIGS. 1*a* to 1*d* are approximately twice-scale side-view cross-sections of the spark plug firing ends of various types of prior art spark plugs.

FIGS. 2*a* to 2*d* are spark plug firing end structures of the present invention representing various levels of idealization in satisfying the various defined (ADPE) criteria. FIG. 2*a* represents the most ideal (and impossible to achieve) structure, and FIG. 2*d* the most practical structure.

FIG. 3 is an approximately 5 times scaled drawing of a side-view cros-ssection of the firing end of a preferred embodiment of the spark plug invention.

FIGS. 3*a* and 3*b* are preferred electrode tips of FIG. 3 showing the electric field contour at the spark plug tip for a new plug tip and a substantially eroded center conductor tip respectively.

DESCRIPTION OF PREFERRED EMBODIMENTS

Figure 4A:
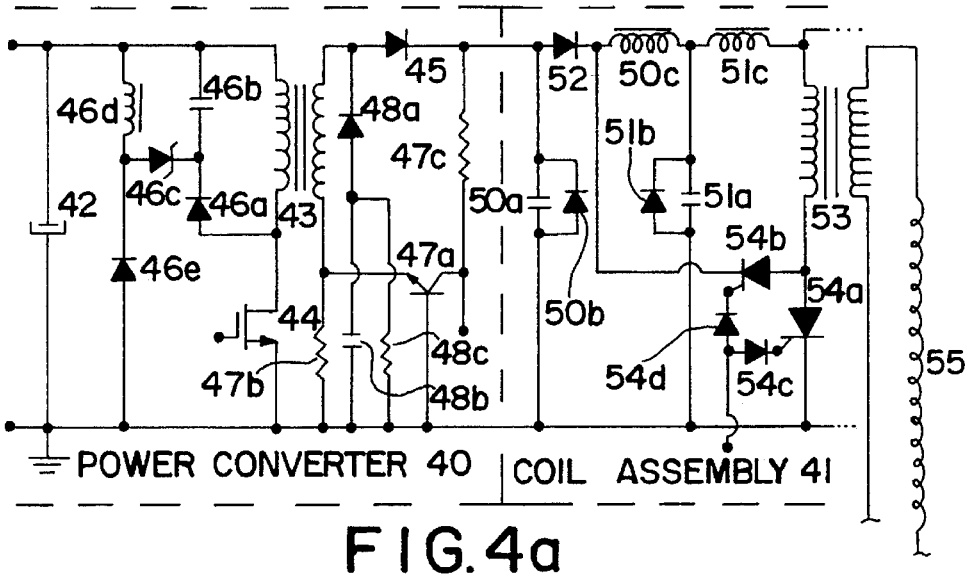
FIG. 4*a* is a circuit drawing of the key components of a preferred embodiment of a distributorless high power hybrid dual discharge ignition producing an are discharge for use with the present spark plug invention, which is shown in FIG. 4*b* approximately to-scale mounted on a cylinder head in a preferred location in the squish zone of an engine with squish.

FIGS. 1*a* to 1*d* are approximately twice-scale side-view cross-sections of spark plug firing ends of various types of prior an spark plug designs, with like numerals representing like parts with respect to the four drawings.

FIG. 1*a* is a conventional spark plug firing end with threaded (typically 14 mm) shell end 10, center high voltage conductor 11, ground "J" electrode 12, insulator end 13, axial spark gap 14, and insulator clearance volume 15 between the surface 16 of the insulator end 13 and the interior surface 17 of the spark plug shell 10.

FIG. 1*b* is a surface gap plug which does not have a "J" ground electrode and instead forms a radial spark gap 14*a* between the inside edge of the shell end 10*a* and the end 11*a* of the center conductor 11, and has no insulator clearance volume 15.

FIG. 1*c* is a circular gap plug with a massive center electrode 18 with a convex outer surface 18a and a circular gap region 14*b* between the end 18*b* of electrode 18 and the inside edge of the shell end 10*a*. This plug gives longer life of the electrode but is of limited gap width, is subject to fouling with an arc discharge, and has a relatively high heat capacity to both quench the initial flame and absorb combustion heat.

The spark plug of FIG. 1*d*, whose center conductor 19 outer surface 19*a* is planar and whose inner surface 19*b* is convex towards the insulator end 13 (reverse of FIG. 1*c*), is less subject to fouling. However, its limitation to a small spark gap, the proximity of its firing surface 19*b* to the insulator end 13, and the massive electrode 19, all add to make for an undesirable design in terms of the (ADPE) criteria already mentioned.

There are many variants of these prior an designs, and while some may better satisfy the ADPE criteria, none of them appear to entirely satisfy the criteria, as does the present spark plug invention.

FIG. 2*a* represents an oblique view (close to side-view) of an ideal but non-physical electrode structure that can, in principle, satisfy all the ADPE criteria. It is comprised of two rings, a high voltage ring 20 and a ground ring 21 making up a double ring or double halo electrode structure which gives the maximum electrode firing area for the minimum electrode mass, and forms the basis for the present invention. Typically, the high voltage ring 20 is of smaller diameter than the ring 21 to produce a spark discharge 22 in between the axial and radial direction, e.g. making an angle of 30 to 60 degrees with the vertical or axial direction, although the spark can be axial by having ring 20 be of approximately the same diameter as ring 21, or horizontal, i.e. true radial, by having ring 20 be smaller and co-planar with ring 21. The electrode structure and hence spark direction depends on several factors, and is typically selected to couple well with the mixture flow, i.e. the spark direction is chosen so that it exposes a large surface to the mixture movement and is more perpendicular than parallel to the mixture flow direction.

FIG. 2*b* shows a one step more physically realizable design of the ideal two ring double halo design of FIG. 2*a*. The required central high voltage conducting wire 11 and ground wire 10*b* are shown and the central high voltage ring 20 (FIG. 2*a*) is replaced by a thin disc 23. The spark gap is unchanged producing a spark 22 between the edges of the two electrodes 23 and 21.

FIG. 2*c* shows a more dimensionally correct, less non-physical structure with central wire 11 (FIG. 2*b* ) replaced by cylindrical wire 11 of typically 2.5 mm diameter and the ground wire 10*b* (FIG. 2*b* ) replaced by three support ground legs 24 (which define a planar structure for ground ring electrode 21 ). The central disc electrode is shaped into a segment or section of a cone 26 with its base, or large diameter end 26*b*, located away from the ground ring and at the spark plug extremity. This geometry produces the highest breakdown electric field at the outer base edge 26*a* of the electrode 26 in an approximately horizontal direction to form a spark 22 with the ground ring 21 which is bowed outward and away from the central support electrode 11, providing better spark penetration into the combustion chamber and a spark discharge that tends to move outward and away from the center of the spark plug end under the influence of engine air-flows.

In FIG. 2*d* is shown a typical cylindrical spark plug shell end structure 7 to which the legs 24 are mounted and the end 28 of an insulator which is recessed below the edge 27*a* of the shell 27. Also, the conical section high voltage electrode 26 has its center hollowed-out to resemble an inverted "V" structure 29 which produces the preferred more outward direction of the spark kernel 22 with less electrode volume to quench the flame. like numerals represent like parts with respect to the previous figures.

For the purposes of the disclosure, the center high voltage electrode will be generally referred to as a "disc", and the terminology "halo-disc" spark plug retained to describe the firing end of the plug.

FIG. 3 depicts a 5-times scaled side-view cross-section drawing of a preferred actual spark plug firing end based on a 14 mm spark plug shell 10 mounted on a cylinder head 30. The central conductor 11 has a diameter d1 of approximately 2.5 mm, with preferably a copper core 11*a*, and with a high voltage firing end 29 of outside diameter (OD) d2 of approximately 6 mm and a ground ring 21 of inside diameter (ID) D2 of approximately 10 mm, with d2 and D2 defining the horizontal dimension (½*(D2–d2)) of the spark gap 31 of length lg of typically 1.5 mm to 4 mm, defined as the largest spark gap that can be fired under all engine operating conditions.

The ground ring 21 is obtained by milling three (or more) slots 25 of width "W" in the ground cylindrical extension piece 32 of length "11" measured with respect to the cylinder head surface 30*a*, leaving a ring of cross-section of about 1 mm by 1 mm. Typically, 11 will be about 3 mm, depending on the desired depth of penetration of the spark gap 31. The inner surface of the extension piece 32 may be constant, decreasing, or stepped of length "12" to reduce the overall diameters of the ring 21 and center conductor end 29 to minimize flame quenching and heat absorption and intensify the breakdown electric field, defining an ID (D2) less than the maximum ID (D1) in the upper part of the clearance volume 15 where the recessed insulator end 13*a* is located. The insulator end 13*b* is above the slot 25 adjacent to the region of maximum ID (D1) to give a clearance to the inside of the shell 17*a* of length 1*c* approximately equal to or greater than the gap length 1*g* to prevent internal firing should the end 13*b* of the insulator 13 become electrically conducting.

In this design the insulator nose section 13*a* is of a length to prevent its fouling, typically about 6 mm. At the base of the nose end 13*a* its diameter increases to form an external sealing seat 33 to dissipate heat to the shell 10 and cylinder head 30. Just above the seat 33 is the internal glass seal 34 for sealing the inner conductor 11 and for providing a heat dissipation path for it.

The firing end 29 of the center conductor can be a thin disk of diameter d2, a conical section, or the hollow connical section shown of FIG. 2*d* of cone angle 45 degrees (typically between 30 and 60 degrees). As discussed with reference to FIG. 2*d*, this design produces a high electric field at its tip 29*a* and directs the spark discharge 22 outwards and away from the gap 31. Both the firing tip 29 and the ground ring 21 are made of erosion resistant material such as Tungsten-Nickel-Iron, and the surface of the center conductor 11 exposed to the flame is also coated with erosion and/or corrosion resistant material.

The clearance volume 15 is larger than normal to prevent internal firing (by providing a maximum for dimension 1*c*) and to minimize flame quenching (from good scavenging of the volume 15). The outer plug region 27 from the end of the main threaded portion 10 to the extension piece 32 is smooth or of a loose thread to prevent plug damage due to the thin wall in region 27.

In FIG. 3*a* is shown the electric field direction 35 from the firing end 29*a* of the center electrode 29 to a smooth surface 21*a*of the ground ring 21. Also shown is the spark kernel 22 resulting from this field for the plug tip of FIG. 3.

In FIG. 3*b* is shown the electric field after the firing end 29 has eroded, showing a more overall horizontally disposed field direction between the new firing end 29*b* and the inside corner 21*b* of the ground ring 21 for a relatively more intense overall electric field in the gap to partially compensate for the increase in the gap length 1*g* and the otherwise increased required breakdown voltage of the larger gap length. For FIGS. 3*a* and 3*b* like numerals represent like parts with respect to FIG. 3.

Figure 4B:
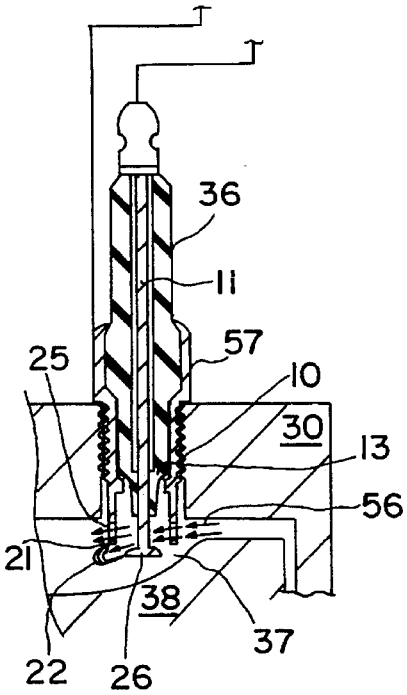

FIG. 4*a* is a circuit drawing of the key components of a preferred embodiment of a distributorless high power hybrid dual discharge ignition producing an arc discharge for the spark for use with the "halo-disc" spark plug 36 shown in FIG. 4*b* approximately to-scale mounted on one end of a cylinder head 30 in a preferred location in the squish zone 37 of an engine with piston 38 induced squish.

The ignition is made up of a power converter stage 40 and coil assembly stage 41, with the required controllers for the two stages not shown. The power converter 40 is a preferred flyback design disclosed elsewhere with input filter capacitor 42, transformer 43, main FET switch 44, ultra-fast output diode 45, and input snubber circuit comprised of isolation diode 46*a*, snubber capacitor 46*b*, low loss snubber control voltage zener 46*c*, inductor 46*d*, and return diode 46*e*. For the preferable continuous mode of operation of the converter an output current sensor comprised of an NPN transistor 47*a* and sense resistor 47*b* are used to control the peak transformer current by diverting control current through off-time control resistor 47*c*. An output snubber circuit comprised of diode 48*a*, capacitor 48*b*, and resistor 48*c* is also shown.

The dual discharge hybrid distributorless ignition coil assembly circuit 41 is comprised of a low frequency (LF) capacitor 50*a*, its shunt diode 50*b*, and its LF inductor 50*c*, a high frequency (HF) capacitor 51*a*, its shunt diode 51*b*, and its HF inductor 51*c*, with isolation diode 52 separating the LF and HF circuits. The coil assembly is made up of one coil per plug, one coil 53 shown in this case with dual SCR switches 54*a* and 54*b* with diodes 54*c* and 54*d* connected to their gates. The secondary of the coil 53 is connected to the spark plug via low resistance inductive suppression wire 55.

The spark plug 36 of FIG. 4*b* is based on the design of FIG. 3 with like numerals representing like pans with respect to FIG. 3. Shown are mixture flow vectors 56 flowing through the shell end slots 25 producing an elongated spark discharge 22 in the direction of the flow for a preferred use of the spark plug and ignition disclosed. The central electrode is a conical section except that in this embodiment its smaller cone diameter is greater than the diameter of the central wire 11, making for a thin disk of approximately 1 mm thickness with tapered ends. The upper pan of the shell 57 is preferably ⅝" hex.

Figure 5:
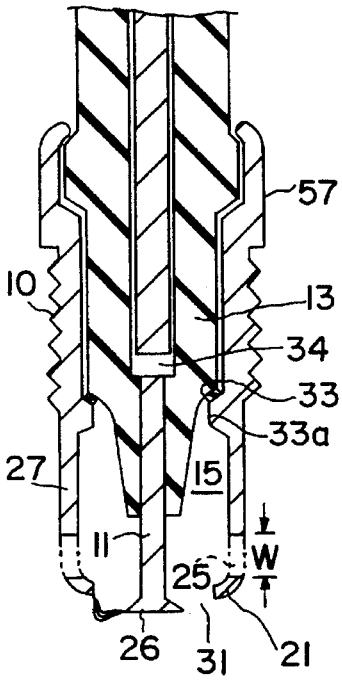
FIG. 5 is an approximately 2.5 times scaled drawing of a side-view cross-section of the firing end of a preferred embodiment of the spark plug invention including the spark plug shell body.

FIG. 5 is an approximately 2.5 times scaled drawing of a side-view cross-section of the firing end of a preferred embodiment of the spark plug invention including the spark plug shell body 57. Like numerals represent like pans with respect to the previous figures. In this embodiment the outer shell region 27 defining the clearance volume 15 is of constant ID and OD except near the tip at the region of the ground ring 21 where it curves inward towards the center conductor whose firing end 26 is a conical section which defines a spark gap 31 with respect to the inward disposed ground ring electrode 21. The end portion of the shell is slotted with a slot 25 of width W as in FIGS. 3, 3*a*, 3*b*, 4*b*. It is noted that in these figures the indented portion (33*a* in this figure) of the ID of the shell where the seat 33 is made is of sufficient length dimension, e.g. about 2 mm, to avoid sharp points and hence high electric field points.

Figure 5A:
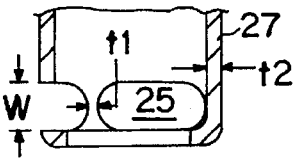
FIG. 5*a* is a side-view of the ground end portion of the spark plug firing end of FIG. 5 showing a preferred slotting of the side wall to achieve the flowthrough firing end feature of the spark plug invention.

FIG. 5*a* is a side-view of the ground end portion of the spark plug firing end of FIG. 5 showing a preferred slotting of width W of the end section of the side wall 27 to achieve the flow-through firing end feature of the spark plug. One complete slot 25 is shown and a partial slot of the preferred three slots, with the thickness of the rib "t1" between the slots being about 1 mm for minimum flame quenching and flow interference but adequate grounding and heat sinking of the ring electrode 21. The other dimension of the rib, "t2", is similar to "t1".

Various modifications to the basic designs of the spark plug can be made to better make us of the principles disclosed herein or to deal with size and structural constraints. These include, and are not limited to, applying the design to different size of spark plug, both diameter and length (¾' thread length was assumed herein for illustrative purposes), achieving greater or less spark penetration beyond the combustion chamber surfaces, plating or insulating the various surfaces exposed to the flame with a wide range of materials such as corrosion and erosion resistant material, heat barrier material such as ceramic coatings, flame enhancing coatings such as palladium oxide, and other modifications which will still be within the scope of the invention. Also, the ranged end, or spark plug tip, of the high voltage electrode can take on a wide variety of shapes and still satisfy the criteria of producing an outward moving spark kernel and minimum heat absorption with good heat sinking so as to not cause engine pre-ignition or knocking.

It is therefore particularly emphasized with regard to the present invention, that since certain changes may be made in the above apparatus and method without departing from the scope of the invention herein disclosed, it is intended that all matter contained in the above description, or shown in the accompanying drawings, shall be interpreted in an illustrative and not limiting sense.

What is claimed is:

1. Spark plug for cyclically fired, large spark gap arc discharge ignition of an air-fuel mixture in a combustion zone with about 100 watts or more of power supplied by the arc with the plug support at or substantially adjacent to a wall defining a portion of such zone and comprising, in combination:

(a) means defining a substantially annular spark plug shell, with an axis, which includes at its end a ground electrode having the form of an electrically conductive ring end;

(b) means defining an axially elongated central high voltage electrode arranged substantially along the axis and terminating within the combustion zone in a thin flanged end defining a spark plug tip, the flanged end plug tip having a low heat capacity and sufficient thermal conductivity to a heat sink formed within the central electrode to limit heating of the flanged end so as to not cause pre-ignition or knocking of the combusting air-fuel mixture in the course of said cyclic arc discharge;

(c) the ground ring electrode and central electrode tip arranged with respect to each other so that they form an annular spark gap in a way that projects at least a portion of the electric field outwardly from the annular gap and includes an at-least-partially axial direction;

(d) means providing a radial gas flow path through the shell at a location adjacent its ground ring electrode end so that:

(i) said end substantially constitutes a suspended ring with at least one axial leg holding it out from the main body of the shell to minimize the ring and leg support areas exposed to the mixture flow and hot combustion gases and to minimize their heat capacity and heat absorption, (ii) and simultaneously the support leg or legs and shell end have sufficient thermal conductivity to the heat sink that the heating of the ground ring electrode is limited to not cause pre-ignition or knocking of the combusting air-fuel mixture or undue temperature accelerated electrode erosion while maintaining the low heat absorption in the course of said cyclic arc discharge, (iii) and the gas flow being effected to sweep combustion products out of the spark plug;

(e) means defining an insulator end section surrounding part of said elongated central high voltage electrode and recessed from said high voltage ranged end spark plug tip;

whereby a continuous high power arc discharge cycling, with severe duty cycle requirements, can be accommodated with limited and controlled erosion of the central electrode and ground ring electrode with essentially consistent spark breakdown voltage characteristics within 40% of the initial values during the defined lifetime of the spark plug.

2. Spark plug in accordance with claim 1 wherein the radial passages of the shell are formed of multiple peripheral slots therein of substantially larger area than the axially extending shell material between slots and forming a path for a gas flow completely across the diameter of the tube to enter at one side via an entrance opening and exit at one or more exit openings placed at least 90 degrees away form the entrance.

3. Spark plug in accordance with claim 2 in combination with means for moving the air-fuel mixture through said path and out of the shell.

4. Spark plug in accordance with claim 3 in combination with means for moving the combustion gas mixture substantially orthogonally to the central electrode and across its flange end for part or all of the cyclical operation.

5. Spark plug in accordance with claim 2 wherein said recessed insulator end is recessed below said flow through slots to minimize insulator fouling and to minimize the electric field from the insulator end to the nearest ground point.

6. Spark plug in accordance with claim 1 wherein the flange end is substantially of disc form.

7. Spark plug in accordance with claim 1 wherein the flange end is a conical section with its large diameter portion at the extremity of the plug end.

8. Spark plug in accordance with claim 7 wherein the flange end is a hollowed-out conical section of an inverted vee cone form.

9. Spark plug in accordance with claim 1 wherein the flange end is a conical section with its large diameter portion "d2" at the extremity of the plug end having a diameter of 3 mm to 8 mm and wherein the inside diameter (ID) "D2" of the ground ring electrode is 6 mm to 12 mm.

10. Spark plug in accordance with claim 9 wherein the radial passages of the shell are formed of multiple peripheral slots therein of substantially larger area than the axially extending shell material between slots with axial width "W" of 2 to 5 mm and wherein the shortest radial distance "1*c*" between an outer end surface of said insulator and an interior shell ground surface is at least 2 mm.

11. Spark plug in accordance with claim 9 wherein said high voltage central electrode tip and said ground ring electrode are made of erosion resistant material and wherein said thickness of said tip is between 0.5 mm and 2.5 mm and cross-section area dimensions of said ring are between 0.5 mm and 2 mm.

12. Spark plug in accordance with claim 11 wilerein said erosion resistant material is Tungsten-Nickel-Iron.

13. Spark plug in accordance with claim 9 wherein maximum ID of said spark plug shell, defined as D1, in the region defined by the threaded portion of said shell and extensions of it, is approximately 10 mm.

14. Spark plug in accordance with claim 9 wherein shell thread is greater than the conventional 14 mm thread.

15. Spark plug in accordance with claim 9 wherein said insulator end section which defines a clearance volume with respect to the interior of the shell end section is of length about 5 mm from its tip to the location where it forms a seat.

16. Spark plug in accordance with claim 9 wherein end section of said annular shell including said one or more legs supporting said ground ring converges inward to produce a ring ID "D2" less than the ID "D1" of the shell section enclosing the clearance volume to define a smaller ring ID less than 10 mm and a smaller diameter "d2" of the flanged end to minimize the exposed electrode area to the flame and intensify the electric field in the spark gap.

17. Spark plug in accordance with claim 9 wherein the center of said annular spark gap extends into the combustion chamber beyond said combustion zone wall by at least 3 mm.

18. Spark plug for igniting air-fuel mixtures and providing a long spark plug electrode life and resistance to plug fouling comprising, in combination:

(a) means defining a substantially annular spark plug shell, with an axis, which includes at its end a ground electrode of erosion resistant material having the form of an electrically conductive ring of ID "D2" between 6 and 12 mm and of ring material cross-sectional area between 0.5 and 4 square mm;

(b) means defining an axially elongated central high voltage electrode of approximately 2.5 mm diameter arranged substantially along the axis and terminating in a thin flanged end of thickness between 0.5 mm and 2 mm and diameter greater than 3 mm defining a spark plug electrode tip;

(c) the ground ring electrode and central electrode tip arranged with respect to each other so that they form an annular spark gap "1*g*" of at least 2 mm in a way that projects at least a portion of the electric field outwardly from the annular gap and includes an at-least-partially axial direction;

(d) means defining an insulator end section surrounding part of said elongated central high voltage electrode and recessed from said high voltage flanged plug tip so that it is recessed with respect to said ground ring electrode;

so that the spark plug provides an operating life of at least twice that of a conventional spark plug with a "J" ground electrode.

19. Spark plug in accordance with claim 18 wherein said annular spark plug shell includes a shell end section extending beyond the wall on which the spark plug is mounted by at least 2.5 mm.

20. Spark plug in accordance with claim 19 wherein said shell end section includes at least two slots of width "W" at least 2 mm wide.

21. Spark plug in accordance with claim 20 wherein said insulator end is recessed to not extend beyond any portion of said shell end section.

22. Spark plug in accordance with claim 21 wherein said slots number three and wherein material between said slots which define ring support legs are of width "t1" between 1 mm and 3 mm.

23. Spark plug in accordance with claim 22 wherein said shell end section converges in the region of said ring so that said ring defines the minimum ID section of said shell end section.

24. Spark plug means for igniting an air-fuel mixture in a combustion chamber comprised of the following:

(a) means for providing minimum and controlled erosion of the electrodes comprised of a ranged central high voltage electrode and ground ring electrode concentric with said flanged electrode and located recessed from said flanged electrode defining a spark gap whose breakdown voltage increases less than proportional to the growth of the spark gap as it erodes;

(b) anti-fouling insulator recessed with respect to said ground ring which separates said central electrode and ground ring electrode;

the spark plug end further constructed and arranged to be of low heat capacity and minimum surface to minimize flame quenching and heat absorption and the electrodes are positioned and oriented to produce a large spark gap with outwardly moving spark kernel and good spark penetration into the combustion chamber with effective coupling of the are discharge to the mixture flow with minimum electrode interference with the initial flame and the bulk flows.

25. Spark plug in accordance with claim 24 wherein said ground ring electrode is supported by three or more legs which define slots between said legs and wherein said legs extend beyond the combustion chamber surface to which the spark plug is mounted.

26. Spark plug in accordance with claim 24 wherein said flanged central electrode is a conical section with its large diameter section "d2" located at the plug tip extremity.

27. Spark plug in accordance with claim 26 wherein said large diameter section of said flanged end is at an axial distance of at least 1 mm from said ground ring electrode.

28. Spark plug in accordance with claim 27 wherein large diameter "d2" of said flanged end is between 4 mm and 8 mm and ID of said ring "D2" is between 7 mm and 12 mm.

* * * * *